United States Patent [19]

Camosso

[11] 4,385,848

[45] May 31, 1983

[54] CARTRIDGE FOR A TYPEWRITER CORRECTION RIBBON

[75] Inventor: Mario Camosso, Banchette, Italy

[73] Assignee: Ing. C. Olivetti & C., S.p.A., Ivrea, Italy

[21] Appl. No.: 232,255

[22] Filed: Feb. 6, 1981

[30] Foreign Application Priority Data

Feb. 8, 1980 [IT] Italy ..... 67188 A/80

[51] Int. Cl.[3] ..... B41J 32/00; B41J 35/04

[52] U.S. Cl. ..... 400/208; 400/248; 400/697.1

[58] Field of Search ..... 400/205.1, 206.2, 208, 400/248, 697, 697.1

[56] References Cited

U.S. PATENT DOCUMENTS

| | | | |
|---|---|---|---|
| 2,634,849 | 4/1953 | Henry | 400/206.2 |
| 3,432,022 | 3/1969 | Priebs | 400/206.2 |
| 3,777,871 | 12/1973 | Zeaner | 400/208 |
| 3,897,866 | 8/1975 | Mueller | 400/208 |
| 3,995,731 | 12/1976 | Miller et al. | 400/229 |
| 4,061,220 | 12/1977 | Cho | 400/697 |
| 4,082,210 | 4/1978 | Gottschlich | 400/208 |

FOREIGN PATENT DOCUMENTS

| | | | |
|---|---|---|---|
| 7073 | 1/1980 | European Pat. Off. | 400/208 |
| 16657 | 10/1980 | European Pat. Off. | 400/208 |
| 1276057 | 8/1968 | Fed. Rep. of Germany | 400/248 |
| 1920010 | 4/1971 | Fed. Rep. of Germany | 400/697.1 |
| 2443443 | 3/1976 | Fed. Rep. of Germany | 400/248 |
| 1451316 | 9/1976 | United Kingdom | 400/697.1 |

*Primary Examiner*—William Pieprz

*Attorney, Agent, or Firm*—Edward F. McKie, Jr.

[57] ABSTRACT

The cartridge comprises a container in which a feed spool 22 and a take-up spool 24 for the ribbon 19 are rotatable. The cartridge is provided with a lateral arm 14 which guides the ribbon between the container and the typing zone 23 and with a distance piece 25 between the container and the arm 14 which disposes the ribbon above the typing point 17 at a higher level than that of the container in order to allow viewing of the characters along the typing line. The distance piece 25 comprises deviation surfaces 56, 57 which constitute a friction device for the ribbon emerging from the container.

13 Claims, 6 Drawing Figures

CARTRIDGE FOR A TYPEWRITER CORRECTION RIBBON

BACKGROUND OF THE INVENTION

This invention relates to a cartridge for a typewriter correction ribbon, as set out in the introductory part of claim 1 .

A cartridge of this type is known, in particular for a hammer typewriter, in which the lateral arm guides the emerging ribbon at the same level as the ribbon disposed in the cartridge container. When in use, in order to allow visibility of the typing line, the ribbon is below the typing point when at rest, and is moved to the typing point during the striking movement for the correction. This cartridge can be mounted on the machine only as an alternative to a typing ribbon cartridge because of the limited space existing between the hammer guide fork of the machine and its paper support platen.

SUMMARY OF THE INVENTION

The object of the present invention is to provide a cartridge for a simple and reliable correcting ribbon which can be permanently mounted on the machine without disturbing normal operation or obstructing visibility of the point to be corrected.

This problem is solved by the cartridge of the invention, which is defined in the characterising part of claim 1.

In this manner, when under rest conditions the visibility of the point to be corrected is ensured, and the ribbon is transferred to the typing point by means of a distance piece which disturbs the visibility of only a few characters in a zone of the typing line which is removed from the correction zone.

DESCRIPTION OF THE DRAWING

The invention will be described in more detail, by way of example, with reference to the accompanying drawing, in which.

DESCRIPTION OF THE ILLUSTRATED EMBODIMENT

Figure 1:
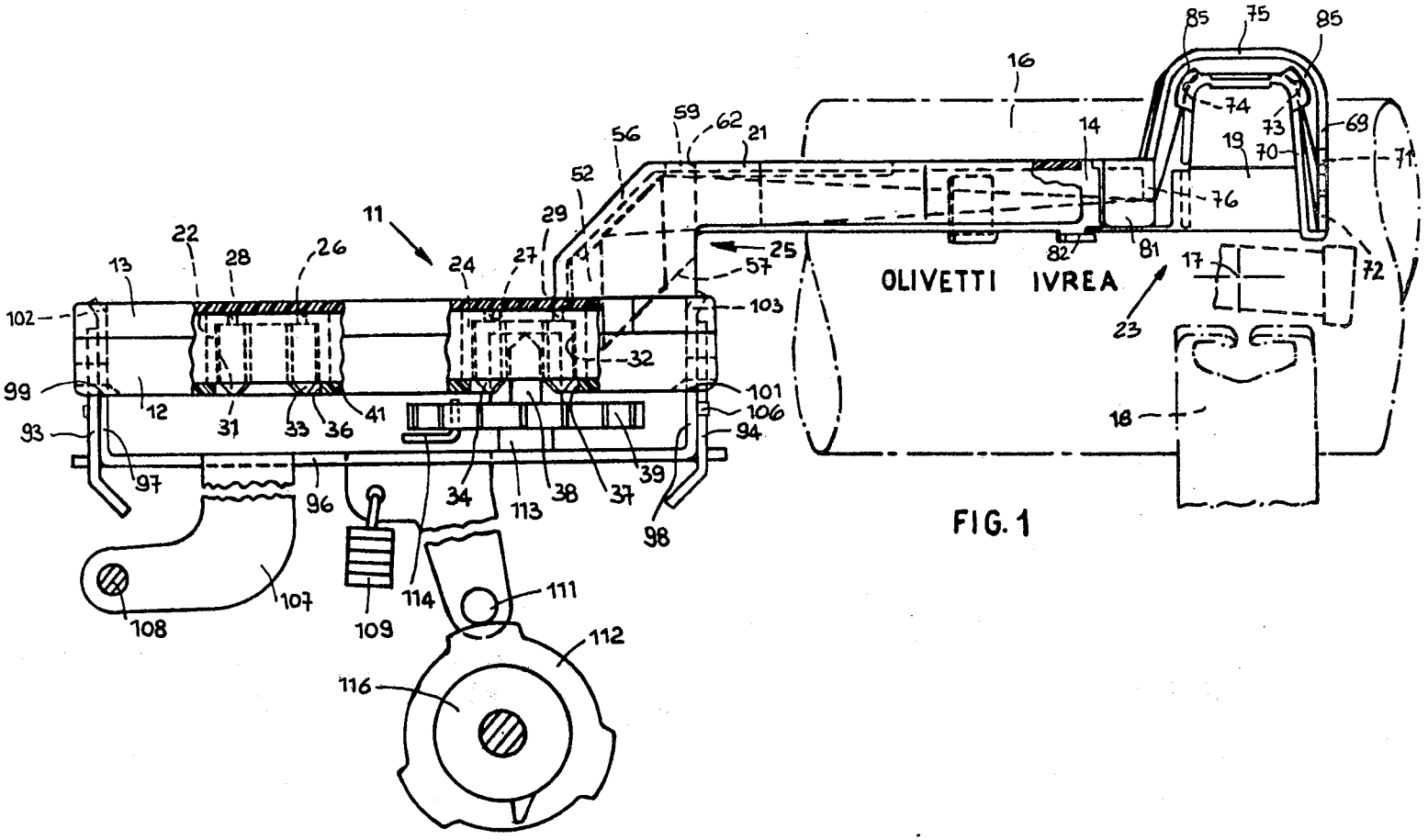
FIG. 1 is a partial front longitudinal view of a cartridge embodying the invention mounted on a support in a typewriter.

With reference to FIG. 1, the correcting ribbon cartridge 11 comprises a plastics container 12 of substantially parallelepiped shape closed at its top by a cover 13. The container 12 is provided on its rear side with an arm 14 which projects towards a paper support plate 16 and extends towards the typing point 17 above a normal type guide 18 in order to guide a correcting ribbon 19 outside the container 12. A portion 21 of the cover 13 at the arm 14 has a stepped part which projects upwards from the horizontal surface of the cover 13, and sideways towards the type guide 18. In this manner, the portion 21 protects the correcting ribbon 19 from any foreign bodies.

The correcting ribbon 19 is wound about a feed spool 22, leaves the container 12 guided as described by the arm 14, passes into the typing zone 23, is deviated by a distance piece 25 and re-enters the container 12 to rewind about a take-up spool 24. Each spool 22, 24 is constituted by a sleeve with a central bore 26, 27 arranged to house a guide tube 28, 29 of the cover 13. Each sleeve 22, 24 has a cylindrical cavity 31, 32 coaxial to the bore 26, 27 which houses a ring gear 33, 34 constituted by four teeth guided by a bore 36, 37 of a base 41 of the container 12. The take-up spool 24 is arranged to cooperate by way of its ring gear 34 with the teeth 38 of a drive element 39.

Figures 2, 3:
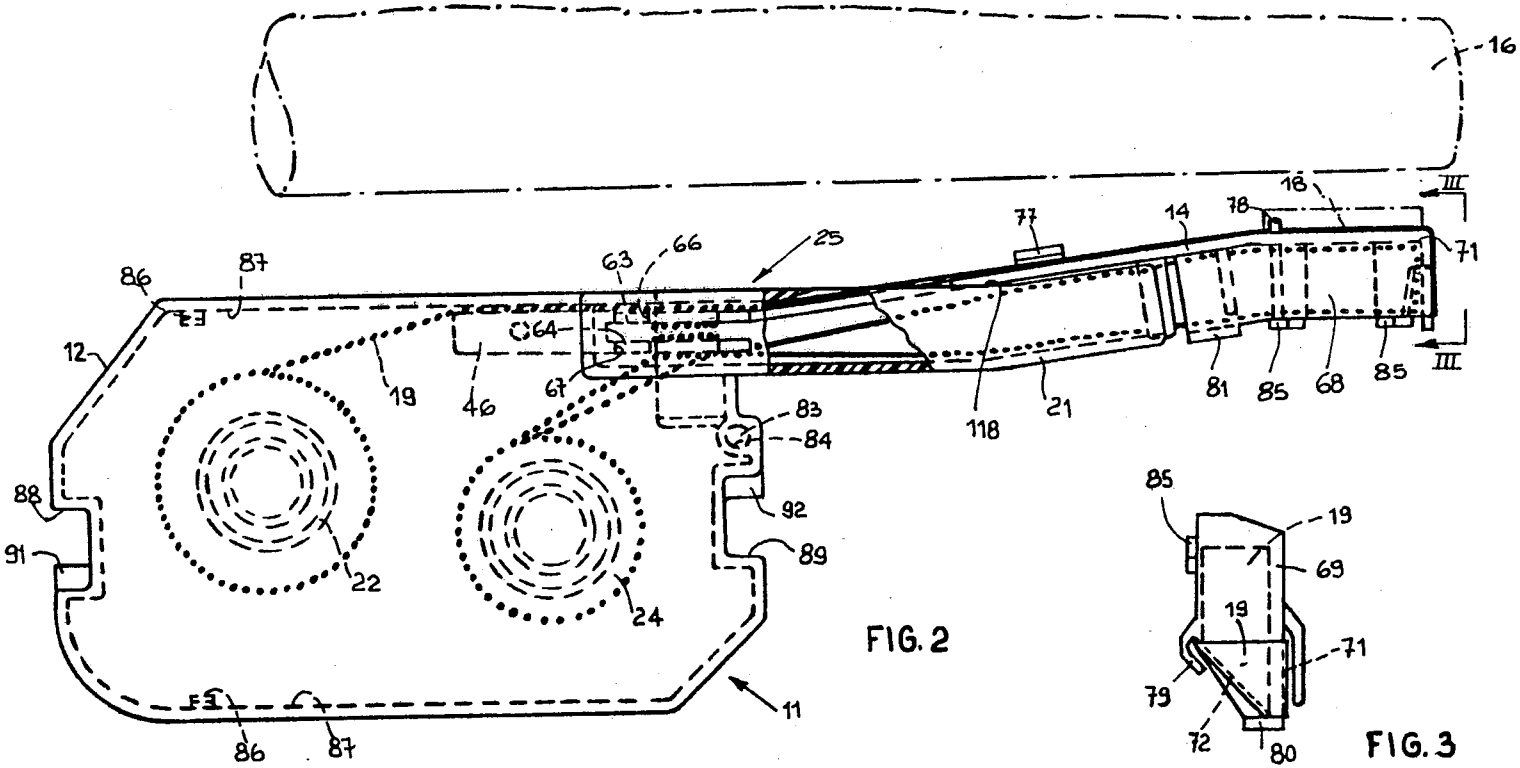
FIG. 2 is a partial plan view of the cartridge of FIG. 1.
FIG. 3 is a partial side view on the line III—III of FIG. 2.
Figure 5:
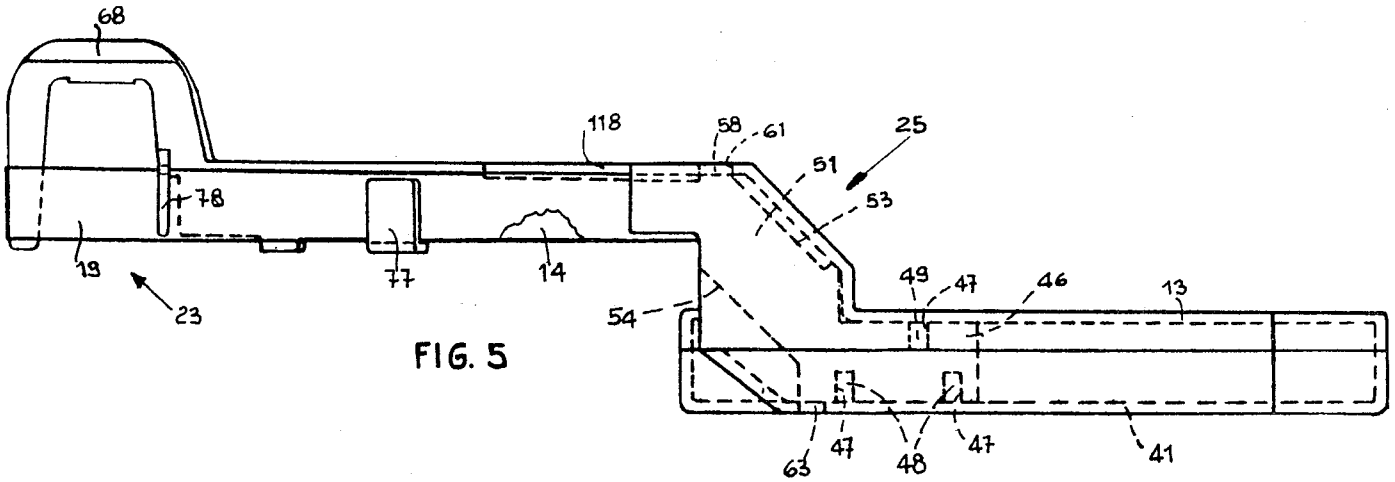
FIG. 5 is a partial rear longitudinal view of the cartridge of FIG. 1.

The arm 14 (FIG. 2) is fixed by means of its distance piece 25 to the container 12 by way of a support 46 comprising three bores 47 (FIG. 5) into which two pins 48 of the base 41 and a pin 49 of the cover 13 are inserted. The support 46 is in one piece with the distance piece 25, which comprises two strips 51 and 52 (FIG. 1) each having two inclined surfaces 53 (FIG. 5) and 54, 56 (FIG. 1) and 57 respectively, arranged to guide the correcting ribbon 19. Each strip 51 and 52 is fixed to the container 12 by means of an upper tab 58, 59 housed in a corresponding slot 61, 62 of the portion 21, and by means of a lower tab 63, 64 housed in a respective slot 66, 67 of the base 41. The arm 14 is constituted by a flexible strip extending parallel to the back wall of the container 12. The strip 14 is rigid at one end with the strip 51 (FIG. 5) and at the other end with a fork element 68 arranged to guide the ribbon 19 in the typing zone 23 parallel to the machine platen 16.

The fork element 68 comprises a wall 69 (FIG. 3) perpendicular to the terminal part of 14, with a shoulder 71 which bends the ribbon 19 through 90° horizontally, perpendicular to the platen, in order to guide it towards an edge 72 (FIG. 3) inclined at 45° to the shoulder 71. The ribbon 19 undergoes at the edge 72 a double bending operation which rotates it through 90° vertically, to convey it towards a horizontal guide 72 (FIG. 6) also in one piece with the strip 14, over which the ribbon turns through 90° parallel to the roller 16. A further horizontal guide 74 guides the ribbon 19 downwards, where a shoulder 76 conveyes it towards the inclined surface 56 of the strip 52. The two supports 73 and 74 are connected together by a wall 70 of U cross-section in one piece with the arm 14, and which together with a similar wall 75 defines a passage corridor for the ribbon 19 which circulates over the typing zone 23, above and to the side of the hammer being struck without excessively obstructing vision of the typed zone. The deviation surfaces, constituted by the shoulder 71, the inclined edge 72 and guides 73, 74 and 76 reverse the direction of the ribbon through 180° by means of fairly smooth bends which prevent excessive pull on the ribbon feed mechanism.

The correcting ribbon unwinds from the feed spool 22, and rests against the rear end of the support 46 to engage the inclined surface 54 (FIG. 6) which turns it through 90° vertically parallel to the platen. Guided by the strip 51, the ribbon 19 slides upwardly and then on the inclined edge 53 so that it becomes disposed along the arm 14, guided by two tongues 77 and 78 (FIGS. 2 and 5), to pass into the typing zone where it lies adjacent and parallel to the platen 16. After being turned by the shoulder 71, the ribbon is guided over the inclined edge 72 by two tongues 79 and 80 (FIG. 3) and is retained on the guides 73 and 74 by tongues 85 and on the shoulder 76 by a vertical tongue 81 and a horizontal tongue 82 (FIGS. 1 and 2), all of which are in one piece with the strip 14. The ribbon 19 is finally conveyed with a 90° twist from the shoulder 76 towards the two inclined surfaces 56 and 57 of the strip 52, and then rewinds on to the collection spool 24.

The cover 13 (FIG. 1) is rigid with the container 12 by means of a pin 83 (FIG. 2) which is normally housed in a bore 84 of the container 12, and by two lugs 86 which collaborate with the inner edges 87 of the container 12. The cartridge 11 comprises two grooves 88 and 89 provided on the sides of the container 12 and cover 13, and two inclined surfaces 91 and 92 disposed on opposite sides of the grooves 88 and 89 are arranged to cooperate with two hooks 93 (FIG. 1) and 94 of a locking and support device 96 of the typewriter, when the cartridge 11 is mounted thereon.

Figure 4:
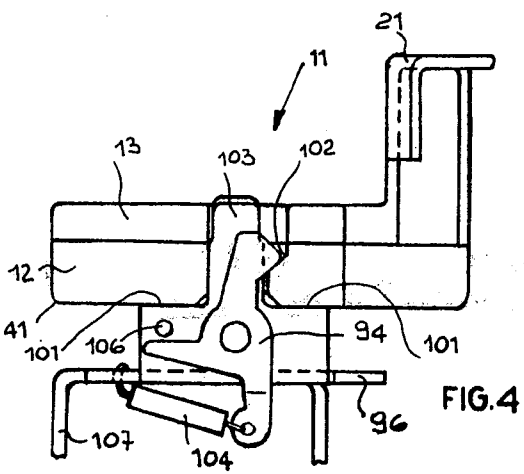
FIG. 4 is a partial side view of FIG. 1.

The locking and support device 96 comprises a substantially rectangular shaped plate with two side walls 97 and 98 having bearing surfaces 99 and 101 arranged to support the cartridge 11 when this is mounted on the support. Each side wall 97 and 98 comprises a strip 102, 103 arranged to lodge in the respective groove 88, 89 of the cartridge 11 to determine the lateral position of the cartridge 11 relative to the typing point 17. The hook 93, 94 is pivoted on each side wall 97, 98, and by the action of a spring 104 (FIG. 4) is rotated in a clockwise direction to stop against the respective inclined surfaces 91, 92 of the cartridge 11 when this latter is mounted on the support 96, or against a stop 106 when the cartridge 11 is removed. Only one spring 104 is shown on the drawings.

The support 96 (FIG. 1) is pivoted by way of a lug 107 on a fixed pin 108, and by the action of a spring 109 is held by way of a cam following roller 111 against a three-lobe cam 112. The cam 112 enables the support 96 to rotate clockwise in order to lower the cartridge 11 and correcting ribbon 19 to the typing point 17 when the correction device is operated. When in the rest position, the support 96 keeps the cartridge 11 and correcting ribbon 19 raised relative to the typing point 17, and the line to be corrected is well visible, with the exception only of the zone behind the distance piece 25, which however is distant at least ten characters from the point to be corrected, and about 30 characters in the illustrated embodiment which shows part of a line of typing in FIG. 1.

The drive element 39 comprises a gear wheel rotatable on a pin 113 of the plate 96 and rigid with the teeth 38 normally engaged with the teeth of the ring 34. A pawl 114 cooperates with the teeth of the wheel 39 to feed the correcting tape 19 at each correction cycle.

To mount the cartridge 11 on the machine, it is held over the plate 96 keeping care to keep the strips 102 and 103 aligned with the grooves 88 and 89. On lowering the cartridge towards the plate, the lower parts of the inclined surfaces 91 and 92 engage with the upper parts of the hooks 93 and 94, causing them to rotate one clockwise and the other anticlockwise against the action of the springs 104 so as to enable the cartridge to lower until it comes to rest with its base 41 against the bearing surfaces 99 and 101. Simultaneously with the lowering of the cartridge 11, the teeth 38 lodge in the spaces of the ring gear 34, so engaging with the collection spool 24. When the cartridge 11 is halted by the bearing surfaces 99 and 101, the springs 104 rotate the respective hooks 93 and 94 until they engage with the respective surfaces 91 and 92, so as to keep the cartridge 11 removably locked on the locking and support device 96.

Figure 6:
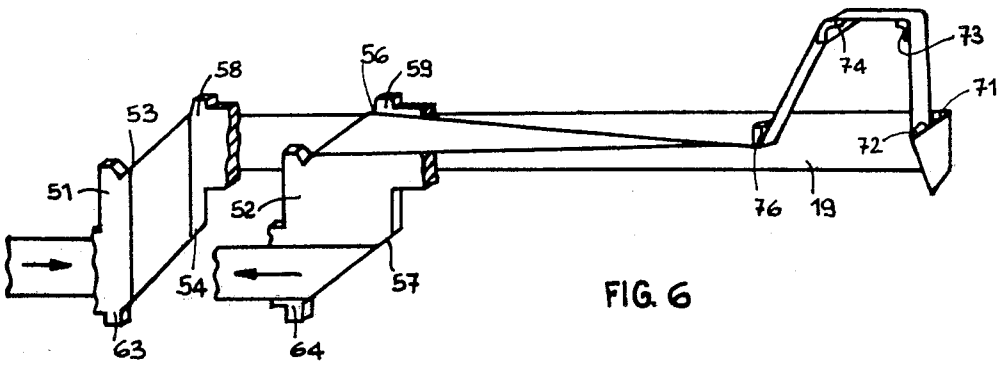
FIG. 6 is a diagrammatic perspective view of the path of the correcting ribbon of the cartridge of FIG. 1.

When the correction key is depressed, the three-lobe cam 112 begins to rotate by way of a clutch 116, and enables the spring 109 to rotate the support 96 in order to move the cartridge 11 so that the ribbon 19 of the utilisation zone 23 is aligned with the typing point 17. During this moment, the pawl 114 engages a tooth of the wheel 39 to rotate the collection spool 24 and thus feed the ribbon 19. In this type of cartridge 11, it will be noted that it is not necessary to provide a friction device on the feed spool 22, because the path executed by the ribbon 19 between the inclined surfaces 53, 54 of the strip 51, and 56, 57 of the strip 53 shown in FIG. 6, is such as to make the friction device superfluous.

If the key of the character to be erased is now depressed, the type hammer engages with that portion of the correcting ribbon 19 (FIG. 1) in the zone 23, to cause it to strike against the platen 16. The arm 14 (FIG. 2) bends slightly to facilitate the resting of the ribbon 19 against the platen 16. When the type hammer returns to rest, the arm 14 also returns to a halt position against a shoulder 118 of the portion 21 which, during the ribbon feed executed by the drive element 39, prevents the arm 14 bending in the opposite direction to that caused by the hammer during correction. After about 120° of rotation, the cam 112 (FIG. 1) raises the support 96 with the cartridge 11. The clutch 116 opens to terminate the erasing cycle. The cartridge 11 is now raised relative to the typing point 17, so that the typed characters are again visible.

What I claim is:

1. A cartridge (11) for use in a correcting ribbon (19) for a hammer typewriter of the type comprising a platen (16) which defines a typing point (17), support means for removably supporting the cartridge (11) and means pivoting the support means between a rest position in which the typing point (17) is visible and a working position in which the cartridge (11) has the correcting ribbon (19) in front of the typing point (17); wherein the cartridge (11) comprises:

a container (12) having a cover lying in a plane (13), a feed-spool (22) and a take-up spool (24) for said correcting ribbon disposed side by side in the container (12);

a lateral arm (14) for guiding the correcting ribbon (19) towards the typing point, wherein said lateral arm lies on a plane disposed above the horizontal plane of the cover (13) and extends at a side of said container towards the typing point (17) parallel to said cover (13); and a distance piece (25) which projects upwardly from the horizontal plane of of the cover at a corner of the container (12) and connects the container (12) with the lateral arm (14), and wherein said distance piece (25) comprises deviation surfaces (53, 54, 56 and 57) for guiding the correcting ribbon (19) among the feed-spool (22), the lateral arm (14) and the take-up spool (24).

2. A cartridge as claimed in claim 1, wherein the lateral arm comprises at its end a fork element, and the distance piece comprises a support adjacent the feed spool and two strips parallel therebetween, each having two inclined surfaces disposed opposite and parallel therebetween and wherein the deviation surfaces comprise said four inclined surfaces.

3. A cartridge as claimed in claim 2, wherein the correcting ribbon unwinds from the feed-spool and, guided by the support, engages a first inclined surface of one strip, said inclined surface turns the correcting ribbon through 90° vertically parallel to the platen, the correcting ribbon slides upwardly until a second inclined surface of one strip turns the correcting ribbon through 90° horizontally disposed along and guided by the lateral arm, engages the fork element which guides the correcting ribbon adjacent to the typing point and successively guides the correcting ribbon towards a third inclined surface of the second strip which turns the correcting ribbon through 90° vertically for sliding downwardly until a fourth inclined surface of the second strip turns the correcting ribbon through 90° horizontally for rewinding on to the take-up spool.

4. A cartridge as claimed in claim 1, wherein the lateral arm is flexible and approaches the platen in response to the striking of the correction ribbon.

5. A cartridge as claimed in claim 3, further comprising reaction element which opposes the lateral arm in order to prevent the bending of the arm away from the platen.

6. A cartridge as claimed in claim 5, further comprising a feed element which cooperates with the take-up spool for winding the ribbon which tends to bend the lateral arm in the direction opposed by the reaction element.

7. A cartridge as claimed in claim 1, wherein the container further comprises a base, and wherein the distance piece is in one piece with the lateral arm and is fixed between the base and the cover of the container.

8. A cartridge as claimed in claim 7, wherein the cover comprises a part which projects upwards from the horizontal plane of the cover and extends parallel to the lateral arm for protecting the distance piece.

9. A cartridge as claimed in claim 5, wherein the container comprises a cover including a protection part for the lateral arm and the reaction element is constituted by a shoulder on said protection part.

10. A cartridge as claimed in claim 1, wherein the deviation surfaces of said distance piece are constituted by inclined edges which impose a double 90° deviation on the correcting ribbon emerging and re-entering the container respectively.

11. A cartridge as claimed in claim 1, wherein the deviation surfaces between the feed spool and the lateral arm constitute a friction device for the ribbon emerging from the container.

12. A cartridge (11) for use in a correcting ribbon (19) for a hammer typewriter of the type comprising a platen (16) which defines a typing line and a typing point (17), support means for removably supporting the cartridge (11) and means pivoting the support means between a rest position in which the typing point (17) is visible and a working position in which the cartridge (11) has the correcting ribbon (19) in front of the typing point (17); wherein the cartridge (11) comprises;

a substantially parallelepipedal container (12) having a cover (13), and including a feed-spool (22) and a take-up spool (24) for said correcting ribbon rotatably mounted in said container (12) and wherein said cover comprises an upper surface which lies on a substantially horizontal plane when the cartridge is supported by said support means in said rest position;

a lateral arm (14) for guiding the correcting ribbon (19) towards the typing point, wherein said lateral arm lies on a horizontal plane disposed above the upper surface of said cover (13) and said typing line, wherein said lateral arm includes a terminal end which spans an external area of said correcting ribbon to lie above said typing point in the rest position of said support means and wherein the external area of said correcting ribbon is caused to be positioned in front of said typing point in the working position of said support means; and a distance piece (25) which projects upwards from the horizontal plane of said cover adjacent the platen and connects the container (12) with the lateral arm (14), wherein said distance piece (25) comprises first and second deviation surfaces (53, 54) for guiding the correcting ribbon (19) from said feed spool upwardly and laterally to said lateral arm and third and fourth deviation surfaces for guiding the correcting ribbon from the lateral arm downwardly and laterally to said take-up spool.

13. A cartridge for a correcting ribbon for a hammer typewriter of the type comprising a platen which defines a typing point, a support for removably supporting the cartridge and means pivoting the support between a rest position in which the typing point is visible and a working position in which the cartridge has the correcting ribbon in front of the typing point, wherein the cartridge comprises a container for housing the correcting ribbon, a lateral arm having a fork element for guiding the correcting ribbon between the container and the typing point, wherein the fork element comprises a vertical shoulder, an edge inclined at 45° with respect and adjacent to the vertical shoulder, a pair of horizontal guides disposed upwards from the vertical shoulder and a horizontal shoulder disposed away from the vertical shoulder, wherein the pair of the horizontal guides are disposed between the vertical shoulder and the horizontal shoulder, wherein the correcting ribbon emerges from the container substantially vertically and engages the vertical shoulder which bends the correcting ribbon through 90° horizontally, perpendicular to the platen, in order to guide the correcting ribbon towards the inclined edge, the correcting ribbon undergoes at the inclined edge a double bending operation which rotates the correcting ribbon through 90° vertically to convey the correcting ribbon towards the first of the pair of the horizontal guides over which the correcting ribbon turns through 90° parallel to the platen and wherein the second horizontal guide of the pair guides the correcting ribbon downwards and towards the horizontal shoulder which conveys the correcting ribbon towards the container.

* * * * *